US008346118B2

(12) United States Patent
Itabashi

(10) Patent No.: US 8,346,118 B2
(45) Date of Patent: Jan. 1, 2013

(54) METHOD FOR ATTACHING CHARGING WIRE, METHOD FOR MANUFACTURING PROCESS CARTRIDGE, AND PROCESS CARTRIDGE

(75) Inventor: Nao Itabashi, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 604 days.

(21) Appl. No.: 12/565,393

(22) Filed: Sep. 23, 2009

(65) Prior Publication Data

US 2010/0080613 A1 Apr. 1, 2010

(30) Foreign Application Priority Data

Sep. 29, 2008 (JP) ..... 2008-249575

(51) Int. Cl.
*G03G 15/02* (2006.01)

(52) U.S. Cl. ..... 399/100; 399/170; 361/225

(58) Field of Classification Search ..... 399/100, 399/111, 115, 170; 361/225
See application file for complete search history.

(56) References Cited

U.S. PATENT DOCUMENTS 7,463,850 B2 12/2008 Itabashi
7,809,306 B2 * 10/2010 Itabashi ..... 399/100
7,813,677 B2 * 10/2010 Itabashi ..... 399/171
8,036,570 B2 * 10/2011 Itabashi ..... 399/111
2006/0018683 A1 * 1/2006 Itabashi ..... 399/170

FOREIGN PATENT DOCUMENTS

JP 04-044649 4/1994
JP 09-311524 12/1997
JP 2006-039139 9/2006

OTHER PUBLICATIONS

Machine translation of reference Suzuki (JP Pub No. 09-311,524 A) Pub date Dec. 2, 1997.*
Office Action received for counterpart Japanese Application 2008-249575, mailed Jun. 15, 2010.

* cited by examiner

*Primary Examiner* — Walter L Lindsay, Jr.
*Assistant Examiner* — Rodney Bonnette
(74) *Attorney, Agent, or Firm* — BAnner & Witcoff, Ltd.

(57) ABSTRACT

The disclosed is a method for attaching a charging wire. At first, a first end of a charging wire is locked to a wire locking portion of a process frame, and portion of a torsion spring shaped wire electrode is engaged with a second end of the charging wire. Thereafter, a coil portion of the wire electrode is attached to a coil support portion of the process frame in a state in which a tension less than a set value is applied to the charging wire. Thereafter, a second spring leg portion of the wire electrode is moved to a fixed position fixed to an electrode support portion of the process frame in a direction in which a deformation amount of the wire electrode increases, without exceeding the fixed position in the first direction.

13 Claims, 10 Drawing Sheets

METHOD FOR ATTACHING CHARGING WIRE, METHOD FOR MANUFACTURING PROCESS CARTRIDGE, AND PROCESS CARTRIDGE

CROSS-REFERENCE TO RELATED APPLICATIONS

This application claims priority from Japanese Patent Application No. 2008-249575, which was filed on Sep. 29, 2008, the disclosure of which is incorporated herein by reference in its entirety.

TECHNICAL FIELD

The present invention relates to a method for attaching a charging wire to a process frame, a method for manufacturing a process cartridge using the attaching method, and a process cartridge suitable for the manufacturing method.

BACKGROUND

In general, a process cartridge includes a photosensitive drum for forming an electrostatic latent image and a corona discharge charger for charging the photosensitive drum by discharge from a charging wire to which voltage is applied. A related-art process cartridge includes: a wire locking portion and an electrode support portion which are formed on a process frame; and a charging wire and a torsion spring shaped wire electrode which are provided between the wire locking portion and the electrode support portion.

Specifically, the charging wire includes ring-shaped hook portions at both ends thereof. The wire locking portion includes: a pair of abutment walls which are arranged to hold therebetween a wire portion of the charging wire so as to lock the hook portion; and a regulating wall which confronts the hook portion.

In this technique, after one end of the wire electrode is supported at the electrode support portion, the hook portion at one end side of the charging wire is engaged with the other end of the wire electrode, and after the hook portion at the other end side of the charging wire is pulled once so as to pass over the regulating wall, the hook portion is locked at the abutment walls, whereby the charging wire is attached to the process frame in a state in which the charging wire is tensioned under a predetermined tension (a set value).

SUMMARY

However, since the hook portion at the other end side of the charging wire is pulled once so as to pass over the regulating wall, a tension equal to or larger than the set value is applied to the charging wire, which may lead to a cut of the charging wire.

An object of the invention is to provide a charging wire attaching method capable of suppressing the application of a tension equal to or larger than a set value to a charging wire, a process cartridge manufacturing method using the attaching method and a process cartridge suitable for the manufacturing method.

According to an aspect of the invention, there is provided a method for attaching a charging wire, comprising: a first step of locking a first end of a charging wire to a wire locking portion formed on a process frame, and engaging a first spring leg portion of a torsion spring shaped wire electrode with a second end of the charging wire; a second step, after the first step, of attaching a coil portion of the wire electrode to a coil support portion formed on the process frame in a state in which a tension equal to or larger than a set value is not applied to the charging wire; and a third step, after the second step, of moving a second spring leg portion of the wire electrode in a first direction in which a deformation amount of the wire electrode increases, and fixing the second spring leg portion to an electrode support portion formed on the process frame by positioning the second spring leg portion at a fixing position, such that the second spring leg portion is moved without exceeding the fixed position in the first direction.

According to another aspect of the invention, there is provided a process cartridge comprising: a charging wire comprising a wire portion and first and second hook portions which are provided at both ends of the wire portion, respectively; a torsion spring shaped wire electrode comprising a coil portion and first and second spring leg portions which are formed at both ends of the coil portion, respectively; and a process frame on which the charging wire and the wire electrode are attached, wherein the process frame comprises: a wire locking portion configured to lock the first hook portion of the charging wire; a coil support portion to which the coil portion of the wire electrode is fitted in a state in which the second hook portion of the wire electrode is engaged with a first spring leg portion; and an electrode support portion to which the second spring leg portion of the wire electrode is fixed, and wherein the coil portion and the coil support portion are configured such that a tension larger than zero but smaller than a set value is applied to the charging wire when the coil portion is fitted to the coil support portion in a state in which the first and second hook portions of the charging wire are respectively engaged with the wire locking portion and the first spring leg portion and in which the second spring leg portion of the wire electrode is disjoined from the electrode support portion.

DESCRIPTION

<Color Printer>

Next, an embodiment of the invention will be described in detail by reference to the drawings as required.

In the following description, directions are defined as directions based on the user who is using a color printer. That is, in FIG. 1, a left side of the figure is referred to as a "front side," a right side of the figure is referred to as a "rear side," a far side of the figure is referred to as a "left side," and a near side of the figure is referred to as a "right side." In addition, a vertical or up-down direction of the figure is referred to as an "up-down direction."

Figure 1:
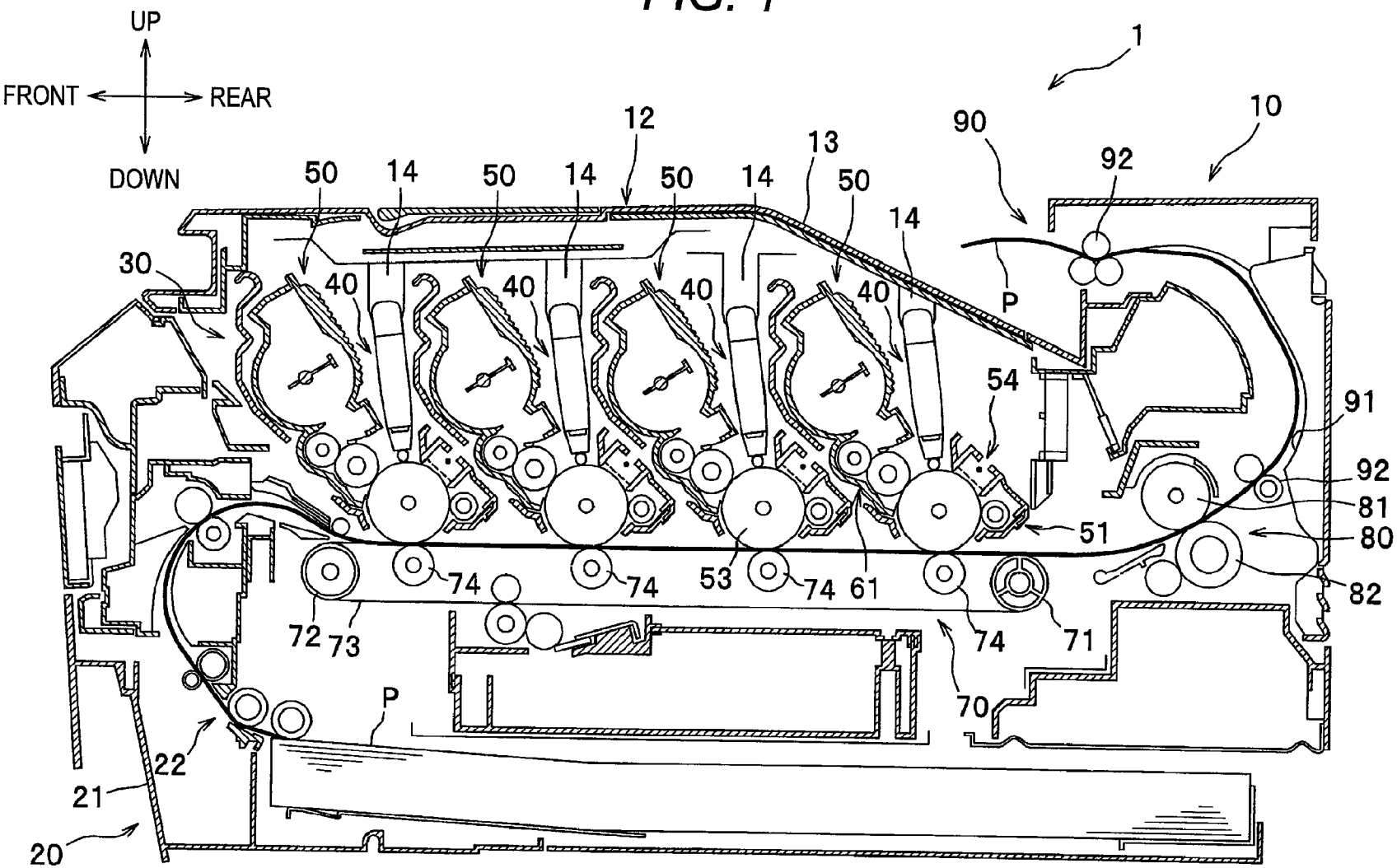
FIG. 1 is a sectional view showing a color printer.

As shown in FIG. 1, a color printer 1 includes, in a body housing 10, a feeder unit 20 configured to feed a sheet P, an image forming unit 30 configured to form an image on the sheet P fed by the feeder unit 20, and a sheet discharging portion 90 through which the sheet P on which the image has been formed is discharged.

An upper cover 12 is provided at an upper portion of the body housing 10 so as to be freely opened about a hinge (not shown) which is provided on a rear side of the body housing 10 as a fulcrum. An upper surface of the upper cover 12 is defined as a sheet discharging tray 13 on which the sheets P discharged from the body housing 10 are stacked. A plurality of holding members 14, each of which holds a LED unit 40, are provided below the upper cover 12.

The feeder unit 20 is provided at a lower portion in an interior of the body housing 10 and includes a sheet feeding tray 21 which is detachably mounted in the body housing 10 and a sheet feeding mechanism 22 configured to convey the sheets P within the sheet feeding tray 21 to the image forming unit 30. In the feeder unit 20, the sheets P stored in the sheet feeding tray 21 are separated and fed to the image forming unit 30 sheet by sheet.

The image forming unit 30 includes four LED units 40, four process cartridges 50, a transfer unit 70 and a fixing unit 80.

Figure 2:
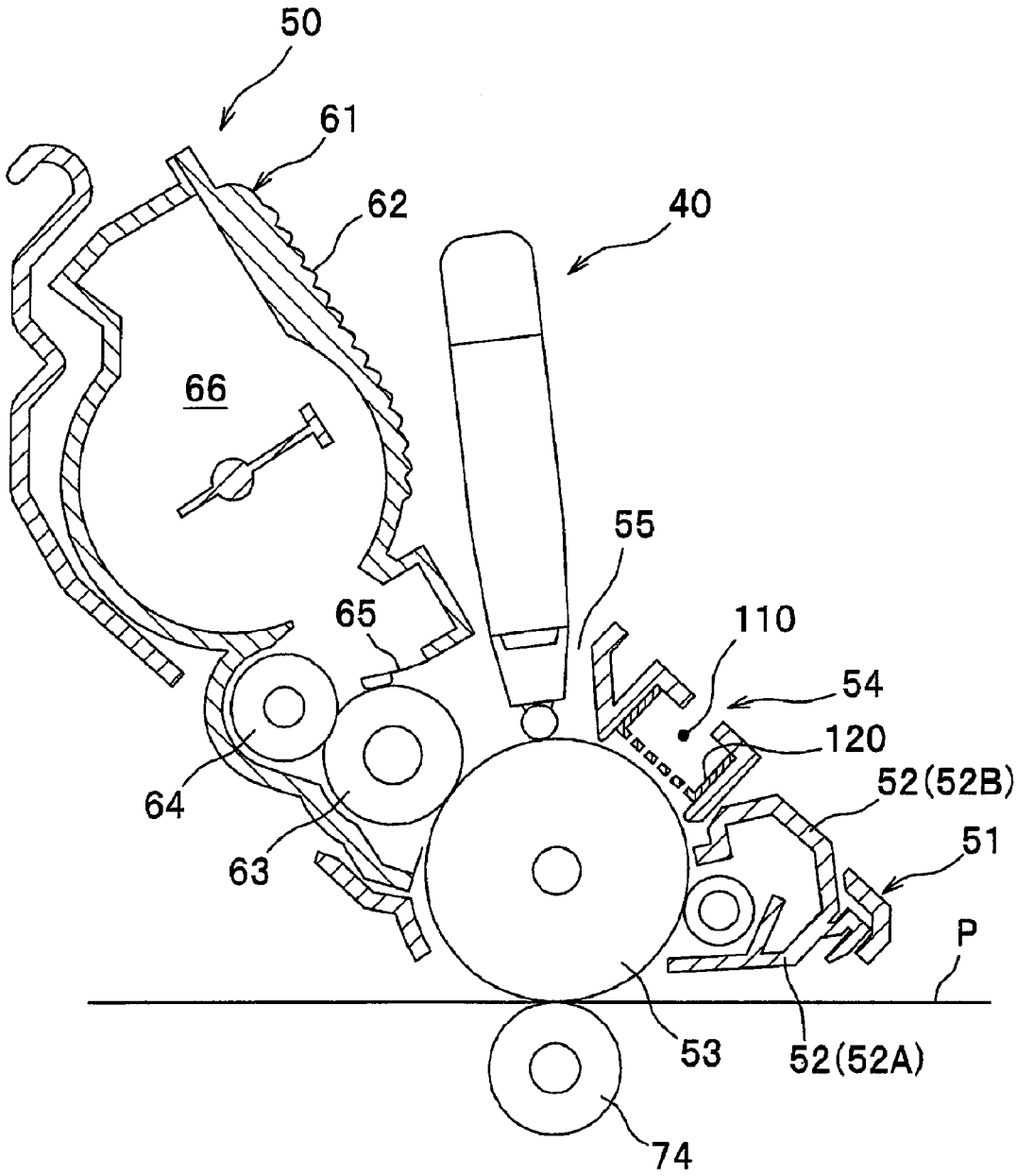
FIG. 2 is an enlarged sectional view showing a process cartridge.

The process cartridges 50 are aligned substantially in a front-rear direction between the upper cover 12 and the feeder unit 20. As shown in FIG. 2, each of the process cartridges 50 includes a drum unit 51 and a developing unit 61 that is detachably mounted relative to the drum unit 51. The process cartridges 50 have the same configuration but are different only in color of toner. The toner is accommodated in a toner accommodation chamber 66 of the developing unit 61.

The drum unit 51 includes a drum frame 52 as an example of a process frame, a photosensitive drum 53 rotatably supported to the drum frame 52, and a charger 54 configured to expose the photosensitive drum 53. The drum frame 52 and the charger 54 will be described in detail later.

In the drum frame 52, an exposure hole 55 facing the photosensitive drum 53 from outside is formed when the developing unit 61 is mounted to the process cartridge 50. The LED unit 40 is inserted into this exposure hole 55 so as to face an upper surface of the photosensitive drum 53.

The developing unit 61 includes: a developing frame 62, a developing roller 63 and a supply roller 64 which are rotatably supported to the developing frame 62; and a blade assembly 65. The developing unit 61 has the toner accommodating chamber 66 configured to accommodate toner therein.

As is shown in FIG. 1, the transfer unit 70 is provided between the feeder unit 20 and the process cartridges 50. The transfer unit 70 includes a drive roller 71, a driven roller 72, a conveyer belt 73 and transfer rollers 74.

The drive roller 71 and the driven roller 72 are spaced apart from and parallel to each other in the front-rear direction. The conveyor belt 73, which is an endless belt, is stretched between the drive roller 71 and the driven roller 72. An outer surface of the conveyor belt 73 contacts the photosensitive drums 53. Four transfer rollers 74 are provided inside the conveyor belt 73 so as to face the respective photosensitive drums 53, thereby nip the conveyor belt 73 with the respective photosensitive drums 53. A transfer bias is applied to the transfer rollers 74 through a constant-current control when images are transferred.

The fixing unit 80 is disposed at the rear of the process cartridges 50 and the transfer unit 70. The fixing unit 80 includes a heating roller 81 and a pressing roller 82 that is disposed to face and press the heating roller 81.

In the image forming unit 30, firstly, the surfaces of the respective photosensitive drums 53 are charged uniformly by the respective chargers 54 and thereafter are exposed by light which is irradiated from the respective LED units 40. Consequently, the electric potential at the exposed portion is lowered, and an electrostatic latent image based on image data is formed on each photosensitive drum 53.

The toner accommodated within the toner accommodation chamber 66 is supplied to the developing roller 63 through rotation of the supply roller 64 and then enters between the developing roller 63 and the blade assembly 65 through rotation of the developing roller 63. Accordingly, the toner is carried on the developing roller 63 as a thin layer having a constant thickness.

The toner carried on the developing roller 63 is supplied to the electrostatic latent image formed on the photosensitive drum 53 when the developing roller 63 faces and contacts the photosensitive drum 53. Accordingly, the toner is selectively carried on the photosensitive drum 53, whereby the electrostatic latent image is visualized, and a toner image is formed through reverse development.

Then, when the sheet P fed onto the conveyor belt 73 is passed between the photosensitive drums 53 and the transfer rollers 74 that are provided inside the conveyor belt 73, toner images formed on the photosensitive drums 53 are transferred sequentially to the sheet P. Thereafter, the sheet P passes between the heating roller 81 and the pressing roller 82, thereby the toner image transferred to the sheet P is thermally fixed.

The sheet discharging portion 90 includes: a sheet discharging side conveyor path 91 extending upwards from an exit of the fixing unit 80 and reverse its course towards the front; and a plurality of pairs of conveyor rollers 92 configured to convey the sheet P. The sheet P to which the toner images has been transferred and thermally fixed is conveyed to the sheet discharging side conveyor path 91 by the conveyor rollers 92, is then discharged out of the body housing 10, and is finally stacked in the sheet discharging tray 13.

<Drum Frame and Charger>

Next, the configuration of the drum frame 52 and the charger 54 will be described in detail.

<Drum Frame>

Figure 3:
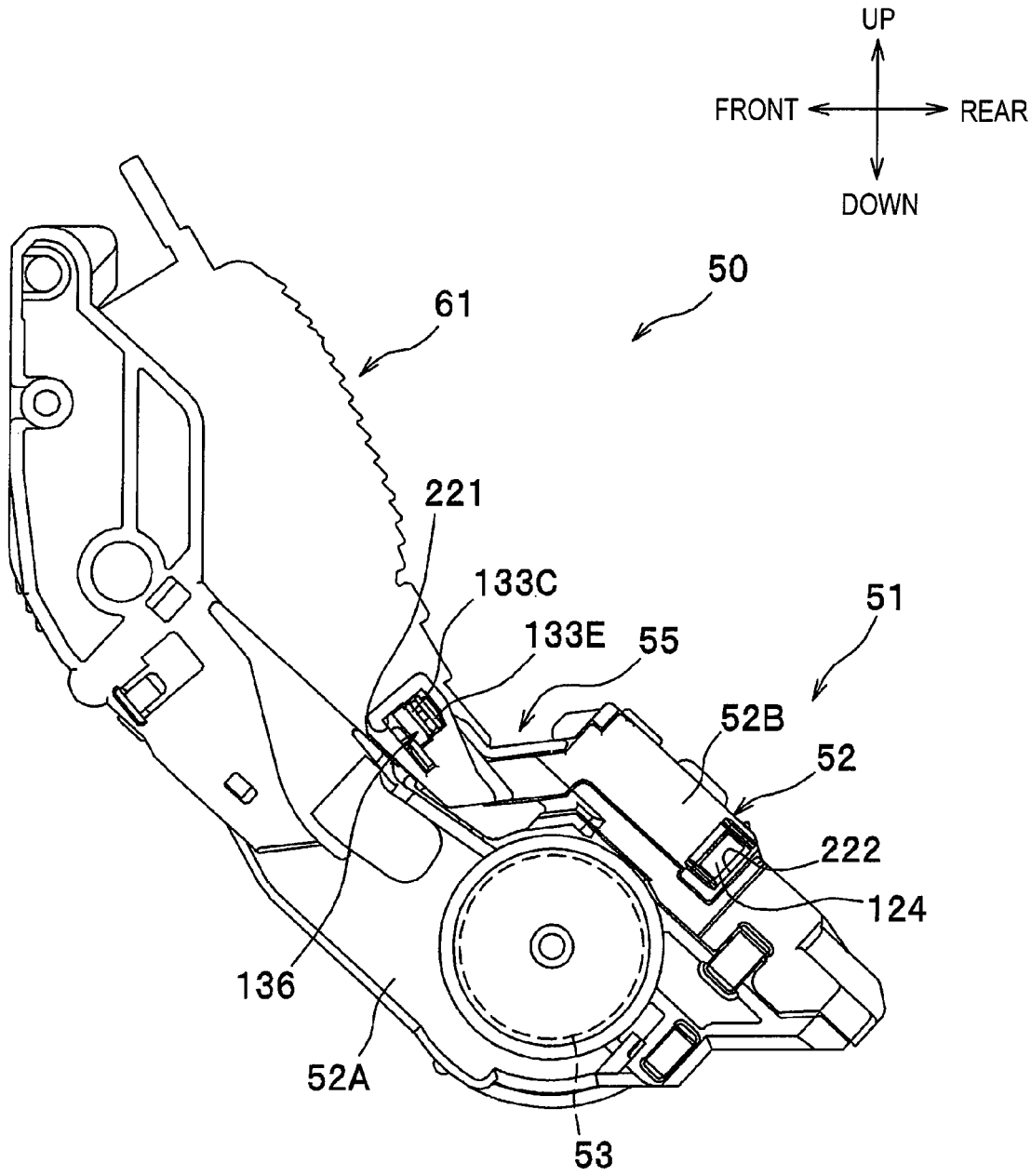
FIG. 3 is a side view of a drum unit and a developing unit.

As shown in FIG. 3, the drum frame 52 includes: a drum lower frame 52A which supports the photosensitive drum 53 and to which the developing unit 61 is removably mounted; and a drum upper frame 52B which supports the charger 54 (see FIG. 2) and which is assembled to the drum lower frame 52A.

Figure 4:
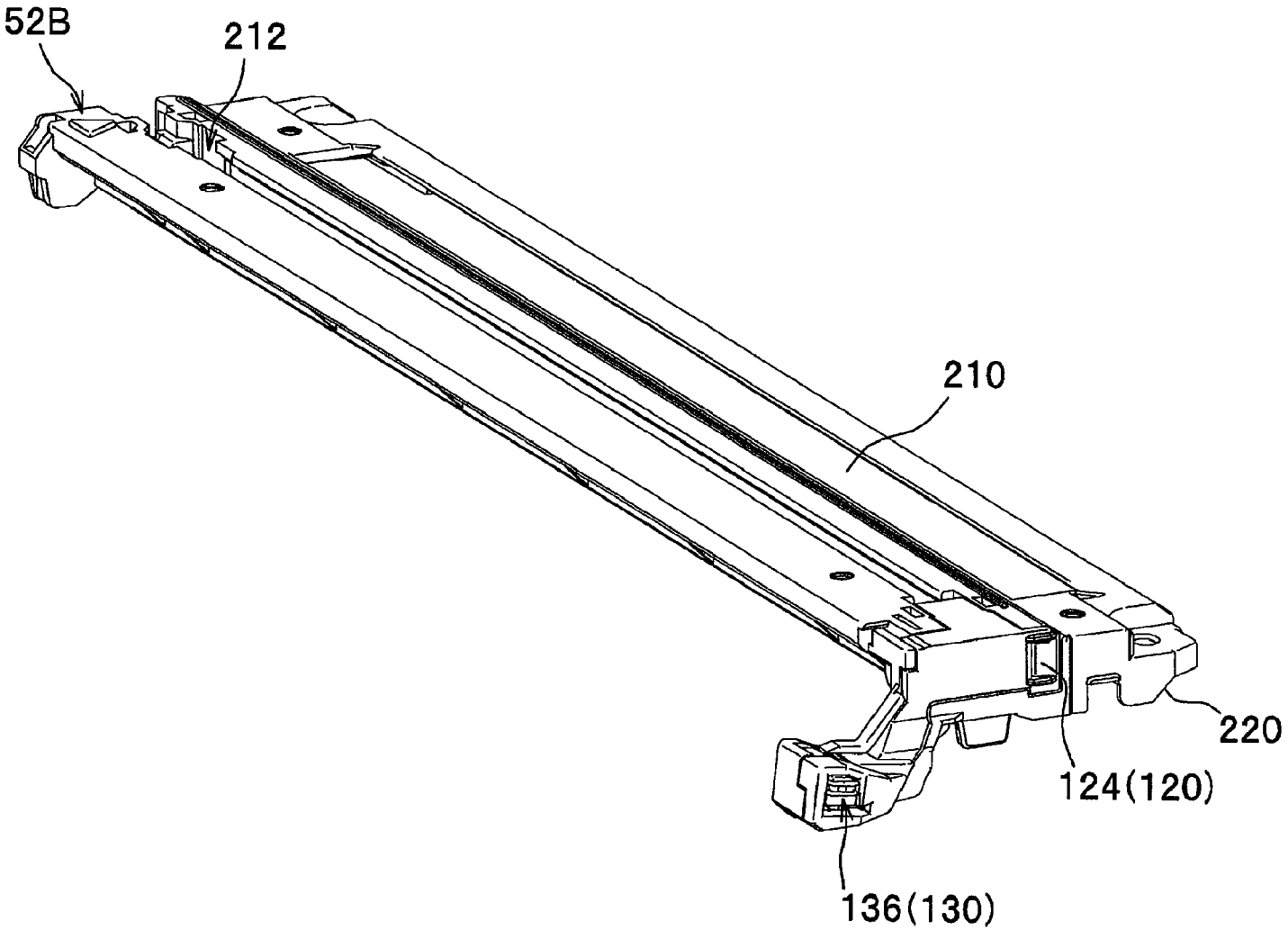
FIG. 4 is a perspective view showing a drum upper frame.
Figure 5A:
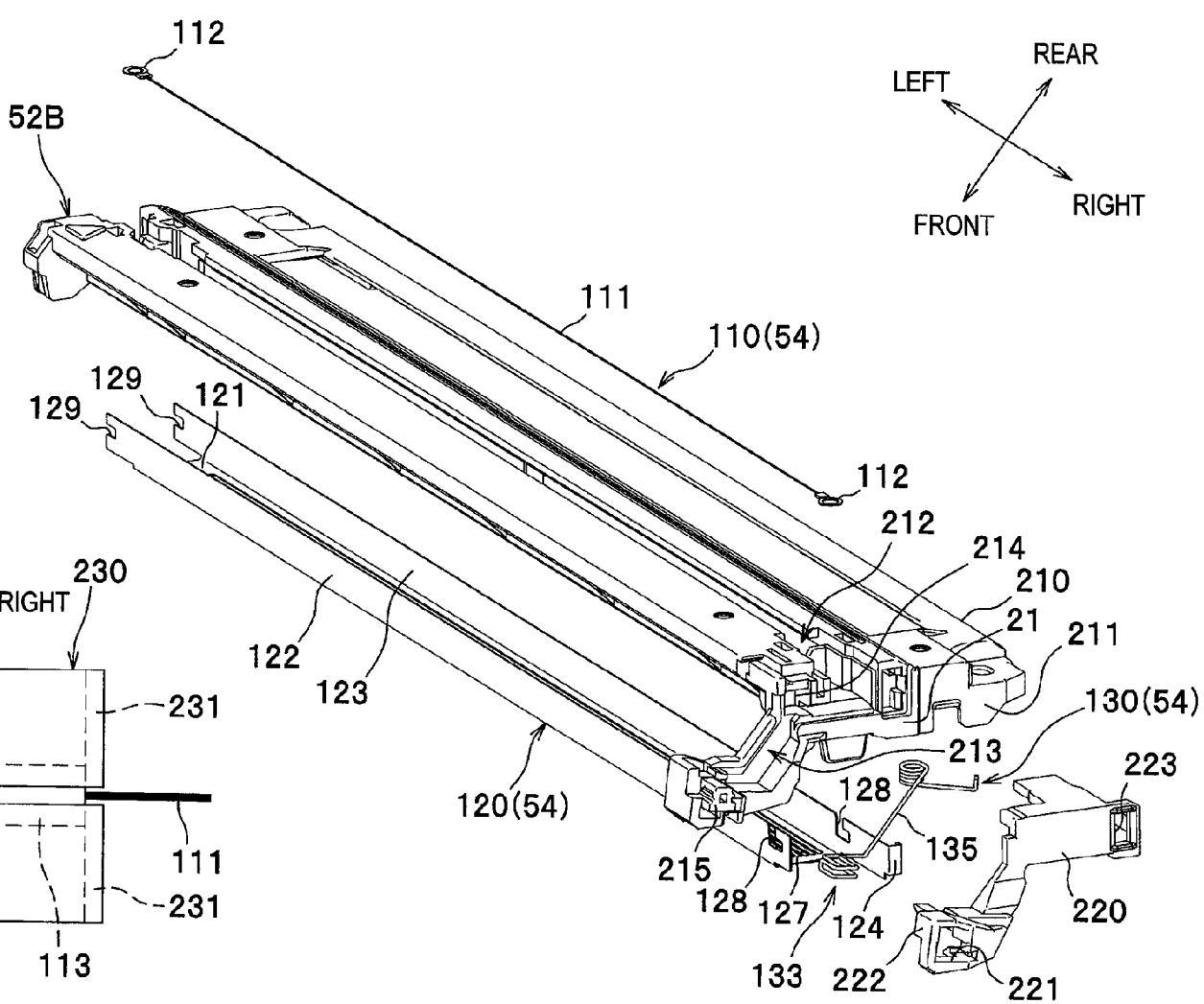
FIG. 5A is an exploded perspective view showing the upper drum frame.

As shown in FIG. 4 and FIG. 5A, the drum upper frame 52B includes: a frame main body 210 which is made of a resin molded product and which extends in a left-right direction; and an electrode cover 220 which is detachably attached to a right surface 211 of the frame main body 210.

An attaching groove 212 to which the charger 54 is attached is formed in the frame main body 210 so as to extend along the left-right direction. A cleaning member (not shown) configured to clean a wire portion 111 of a charging wire 110 (described later) is provided slidably in the attaching groove 212.

Figure 5B:
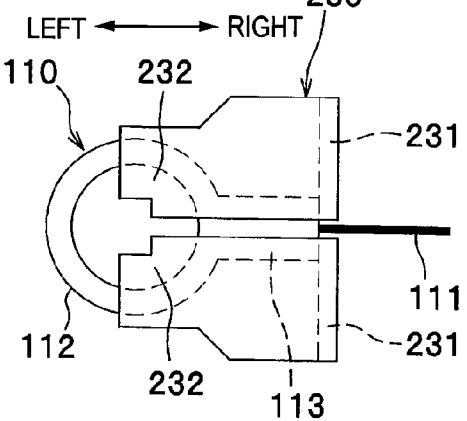
FIG. 5B is a plan view showing a wire locking portion.

As shown in FIG. 5B, a wire locking portion 230 configured to lock a ring hook portion 112 which lies at a left end side of the charging wire 110 is formed on a left side of a bottom wall of the attaching groove 212. The wire locking portion 230 includes a pair of abutment walls 231 which regulate a rightward movement of the ring hook portion 112 and a pair of regulating walls 232 which regulate an obliquely upward and rearward (an axial direction of the ring hook portion 112) movement of the ring hook portion 112.

The abutment walls 231 are arranged so as to hold therebetween the wire portion 111 of the charging wire 110, and to lock a rectangular root portion 113 which is formed integrally with an outer circumferential edge of the ring hook portion 112. The regulating walls 232 extend leftwards from the corresponding abutment walls 231 and are disposed so as to face the ring hook portion 112. In addition, the regulating walls 232 extend so as to face a portion of the ring hook portion 112 which lies further leftwards (outwards in a direction in which the charging wire 110 is stretched) than the center of the ring hook portion 112, whereby a half or more portion of the ring hook portion 112 is supported by the regulating walls 232. As used herein, the term "direction in which the charging wire 110 is stretched" denotes a direction in which a tension is applied to the charging wire 110 in a state in which the charging wire 110 is attached to the frame main body 210.

Figure 7A:
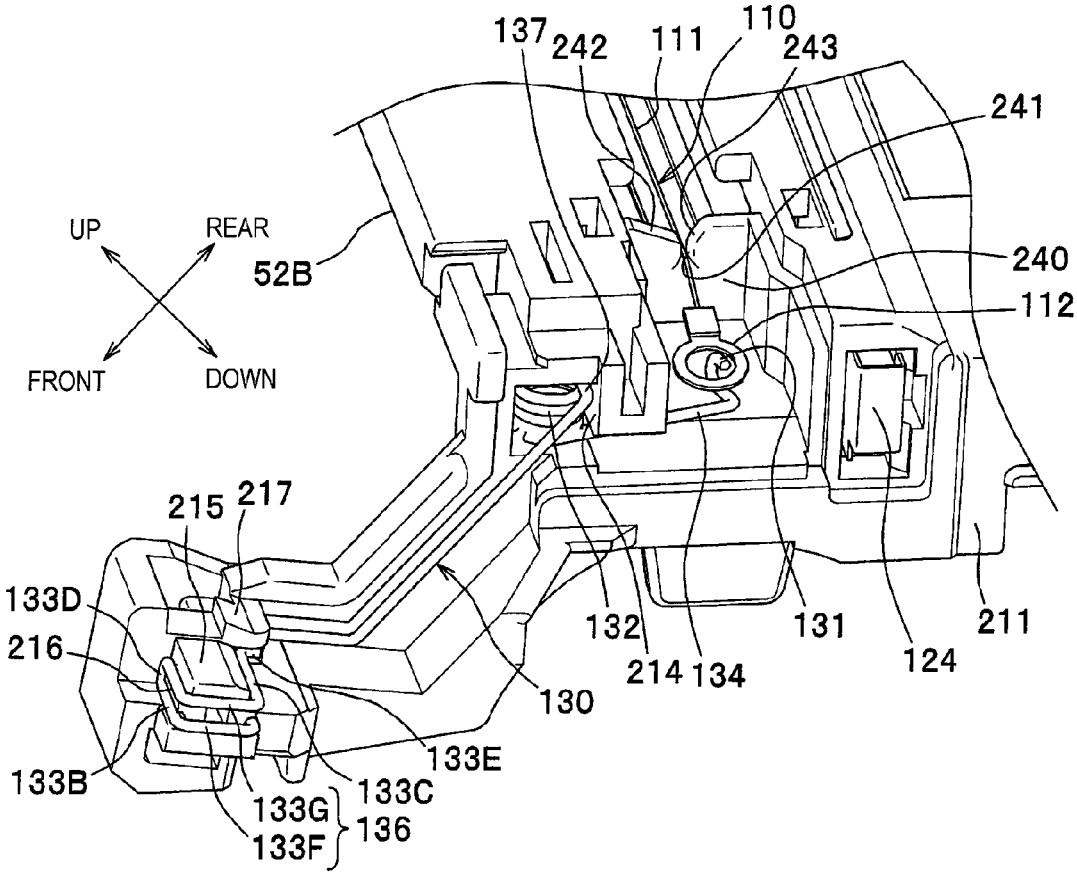
FIG. 7A is an enlarged perspective view showing a state in which the wire electrode is attached to the drum upper frame.

As shown in FIG. 7A, a wire support wall 240 is formed on a right side of the bottom wall of the attaching groove 212, and a groove 241 is formed in the wire support wall 240 into which a right portion of the wire portion 111 of the charging wire 110 enters. In addition, a pair of inclined surfaces 242, 243 are formed on both sides of an opening in the wire insertion groove 241 in the wire support wall 240 so as to introduce the wire portion 111 of the charging wire 110 into the wire insertion groove 241.

Figure 7B:
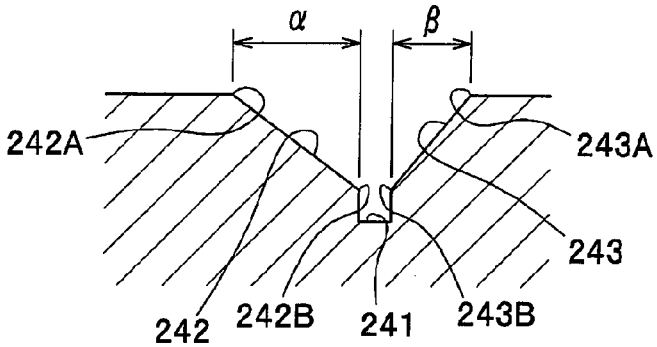
FIG. 7B is a sectional view showing an inclined surface.

Of the pair of inclined surfaces 242, 243, the inclined surface 242 which lies on a side closer to a holding hole 214 (a coil portion 132) (described later) is formed at a more gentle angle than an angle at which the opposite inclined surface 243 is formed. In other words, as shown in FIG. 7B, an introduction width $\alpha$ of the holding hole 214 side inclined surface 242 is made larger than an introduction width $\beta$ of the opposite inclined surface 243. As used herein, the term "introduction widths" mean distances from edges 242A, 243A of the inclined surfaces 242, 243 which lie farthest from the wire insertion hole 241 to edges 242B, 243B which lie nearest to the wire insertion groove 241 when the wire insertion hole 241 is viewed from an opening side thereof. By providing the inclined surfaces 242, 243 in that way, even when the charging wire 110 is inclined relative to its normal posture caused by locating the right portion of the charging wire 110 to the holding hole 214 side closer than its normal position at a time of attaching the charging wire 110, since the inclined surface 242 formed wider faces the wire portion 111 of the charging wire 110, the wire portion 111 of the charging wire 110 can be guided into the wire insertion groove 241 along the inclined surface 242.

Figure 6A:
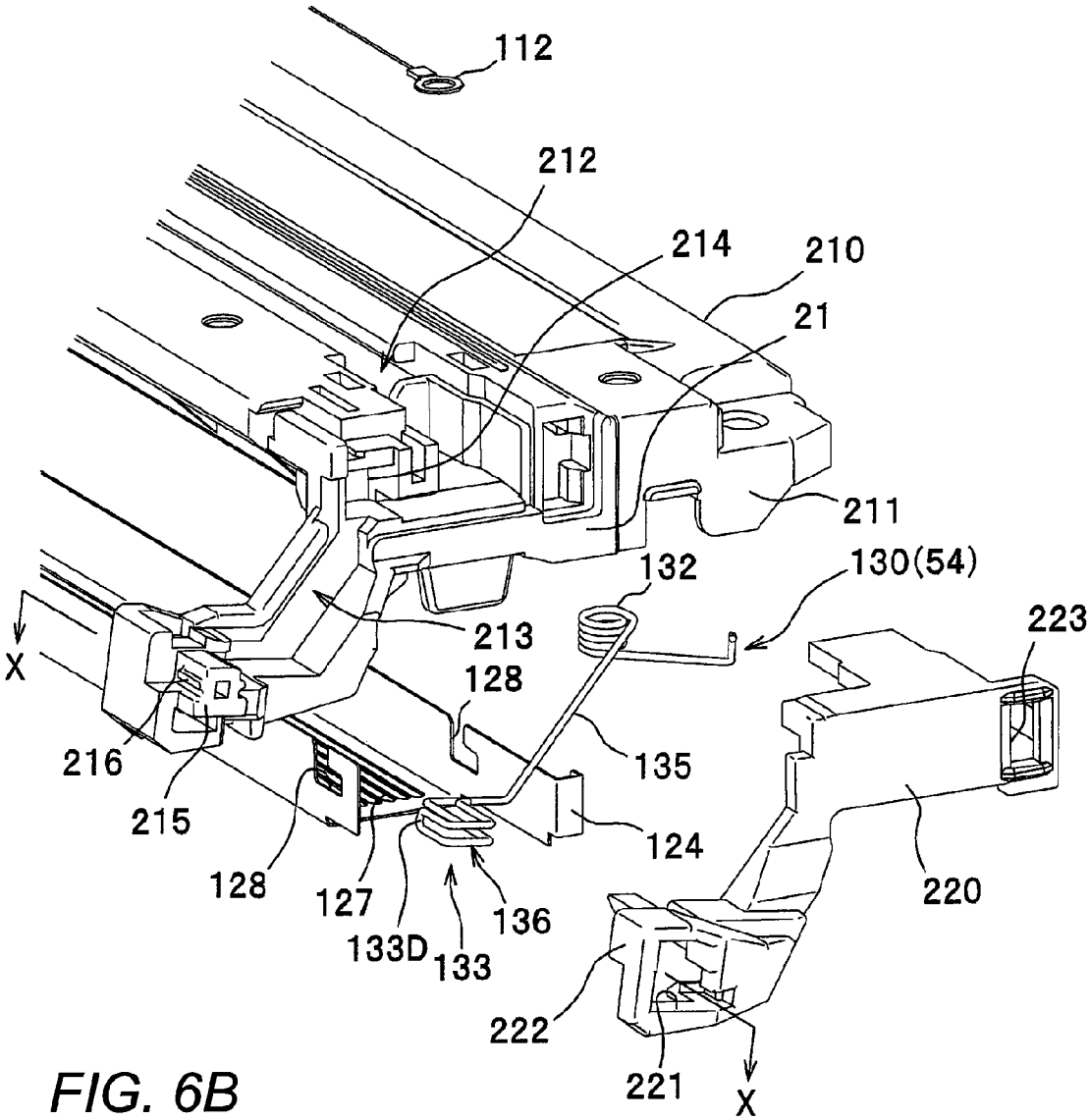
FIG. 6A is an enlarged view showing in detail a right portion of a frame main body, a wire electrode and an electrode cover.

As shown in FIG. 6A, an electrode attaching portion 213 in which a wire electrode 130 (described later) is disposed is formed on a right surface 211 of the frame main body 210 so as to match the shape of the wire electrode 130. Specifically, this electrode attaching portion 213 extends forwards from a front end portion of the frame main body 210.

The holding hole 214 functions as an example of a coil support portion that supports a coil portion 132 of the wire electrode 130 (described later) through fitting. The holding hole 214 is formed into a rectangular bottomed shape at a portion (a base portion of the electrode attaching portion 213) on the right surface 211 of the frame main body 210 and the front side of the attaching groove 212. Further, an electrode support portion 215 is formed on the front side of the holding hole 214 and configured to fix a distal end portion (an engagement portion 133) of a second spring leg portion 135 of the wire electrode 130.

The electrode support portion 215 is formed to protrude rightwards from a front end portion of the electrode attaching portion 213. In addition, an engagement rib 216, which protrudes so to allow an engagement with the engagement portion 133 of the wire electrode 130, is formed on a front surface of the electrode support portion 215.

The electrode cover 220 is a cover which covers the wire electrode 130 and defines a space which accommodates the wire electrode 130 between the electrode attaching portion 213 and the frame main body 210. A first opening 221 is formed in a front end portion of the electrode cover 220 through which at least a part (a wire side main body connecting portion 136) of the wire electrode 130 is exposed to the outside.

Figure 6B:
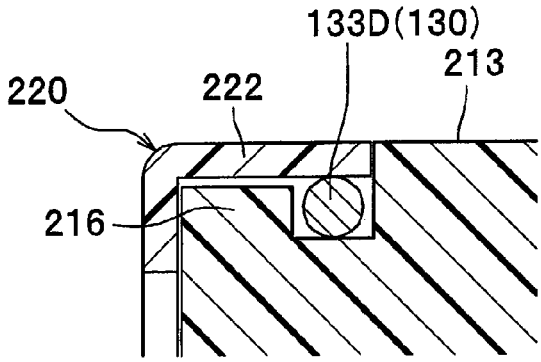
FIG. 6B is a sectional view taken along the line X-X in FIG. 6A.

A front wall 222 at the front end portion of the electrode cover 220 is disposed so as to cover the engagement rib 216 and the engagement portion 133 (specifically, a connecting portion 133D and the like) of the wire electrode 130 which is brought into engagement with the engagement rib 216. Specifically, as shown in FIG. 6B, the front wall 222 of the electrode cover 220 lies adjacent to the engagement rib 216 and the connecting portion 133D of the wire electrode 130 so that a gap between the front wall 222 and the engagement rib 216 is smaller than the diameter of the wire electrode 130. Accordingly, the disengagement of the connecting portion 133D of the wire electrode 130 from the engagement rib 216 is suppressed.

A second opening 223 is formed in a rear end portion of the electrode cover 220 through which a grid side main body connecting portion 124 (see FIG. 4) is exposed to the outside.

<Detailed Configuration of Charger>

As shown in FIG. 5A, the charger includes the charging wire 110, a grid 120 and the wire electrode 130.

The charging wire 110 includes the metallic wire portion 111 and the pair of ring hook portions 112 as examples of hook portions which are attached to both ends of the wire portion 111. The charging wire 110 is stretched along the left-right direction (an axial direction of the photosensitive drum 53) by: engaging the ring hook portion 112 at the left end side of the charging wire 110 with the wire locking portion 230 (see FIG. 5B) on the drum upper frame 52B; and pulling the ring hook portion 112 at the right end side thereof by the wire electrode 130 (described later).

The grid 120 includes: a lower panel 121 which extends in the left-right direction, that is, the direction in which the charging wire 110 is stretched; and a front panel and a rear panel which protrudes upwards from front and rear ends of the lower panel 121, respectively. Accordingly, the grid 120 is formed into a U shape by the lower panel 121, the front panel 122 and the rear panel 123 when viewed from the side.

The lower panel 121 is disposed between the photosensitive drum 53 and the charging wire 110 in a state in which the grid 120 is assembled to the drum upper frame 52B. A plurality of slit-shaped grid holes 127 are formed in the lower panel 121.

The front panel 122 is formed longer than the lower panel 121 in both left-right directions. An L-shaped cut-out portion 128 is formed in a right end portion of the front panel 122 so as to open upwards (towards the drum upper frame 52B) as viewed in FIG. 5A. The cut-out portion 128 is formed to extend first vertically downwards and then turn towards the right as shown in FIG. 5A so as to be formed into the L shape. A cut-out portion 129 is formed in a left end portion of the front panel 122 so as to open to the left.

Similar to the front panel 122, a cut-out portion 128 and a cut-out portion 129 are formed in the rear panel 123. In addition, a right end portion of the rear panel 123 is formed to extend longer than the right end of the front panel 122 and is bent twice in an opposite side (outwards) to the lower panel, whereby the right end portion is formed into a hook-like shape. Accordingly, a right end face of the rear panel 123 configures a grid side main body connecting portion 124 which contacts a pin-like main body electrode (not shown) which resides on the main body housing 10 for electrical connection.

In addition, the cut-out portions 128 and the cut-out portions 129 allow an engagement of the grid 120 with the drum upper frame 52B.

The wire electrode 130 is provided for applying voltage to the charging wire 110 and is formed by a metallic linear member being bent so as to be formed into a torsion spring shape. Specifically, as shown in an enlarged view in FIG. 8, this wire electrode 130 includes: the coil portion 132, a first spring leg portion 134 and the second spring leg portion 135 which are formed at both ends of the coil portion 132; a wire connecting portion 131 which is formed at a leading end of the first spring leg portion 134; and the engagement portion 133 which is formed at a leading end of the second spring leg portion 135.

The wire connecting portion 131 is formed into a U-shaped hook shape, and the wire connecting portion 131 is electrically connected to the charging wire 110 by hooking the wire connection portion 131 on the ring hook portion 112 of the charging wire 110 as shown in FIG. 7A.

The coil portion 132 has a coil shape and imparts a tension to the charging wire 110 via the first spring leg portion 134 and the wire connecting portion 131 in a state in which the wire electrode 130 is attached to the charging wire 110 and the drum upper frame 52B. Specifically, the coil portion 132 is fitted in the holding hole 214 with a predetermined fitting force, whereby a tension which is larger than zero but smaller than a set value is made to be applied to the charging wire 110 when the coil portion 132 fits in the holding hole 214 in a state in which the ring hook portions 112 of the charging wire 110 are engaged with the wire locking portion 123 and the first spring leg portion 134 of the wire electrode 130, respectively, and in which the second spring leg portion 135 of the wire electrode 130 is disjoined from the electrode support portion 215.

Figure 8:
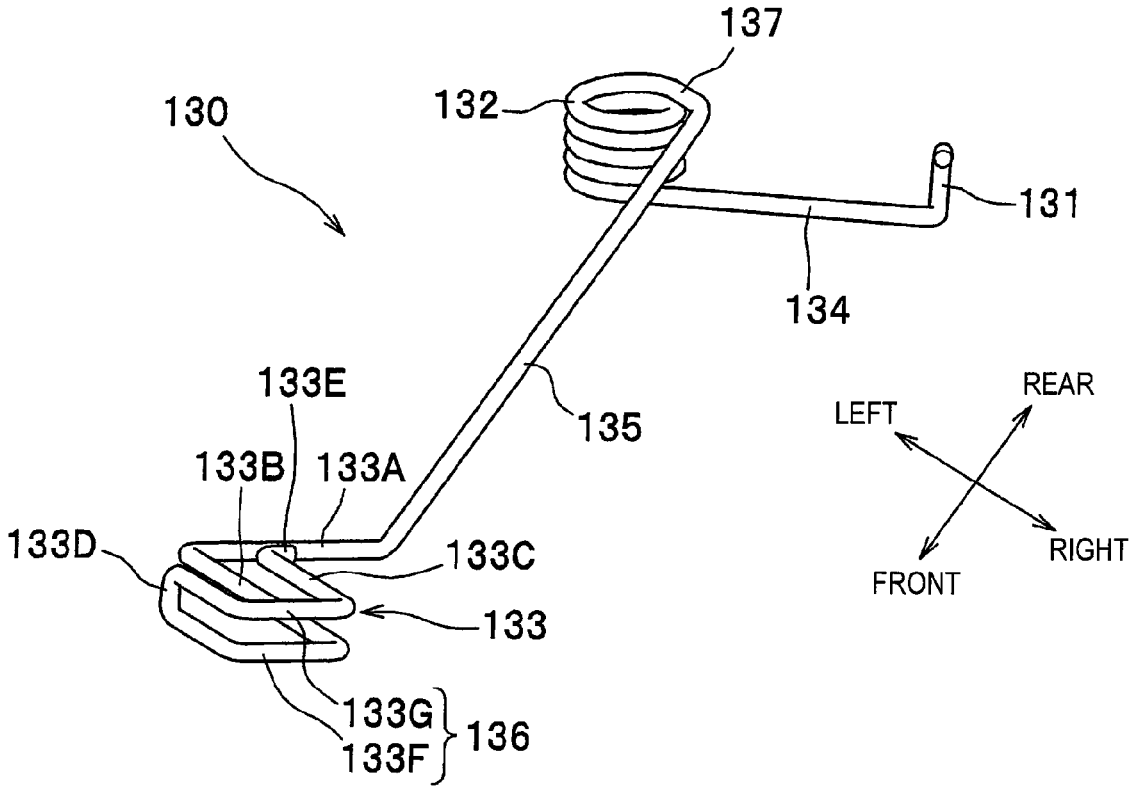
FIG. 8 is an enlarged perspective view of the wire electrode.

As shown in FIG. 8, the engagement portion 133 includes: an extended portion 133A; a first engagement portion 133B and a second engagement portion 133C which have a U shape; a connecting portion 133D which connects the first engagement portion 133B with the second engagement portion 133C; and a third engagement portion 133E.

The extended portion 133A extends obliquely forwards and upwards from a front end of the second spring leg portion 135.

Each of the first engagement portion 133B and the second engagement portion 133C is bent to have a U shape which is made to open to the left. The first engagement portion 133B and the second engagement portion 133C are disposed so as to become parallel to each other and fit on the electrode support portion 215 on the drum upper frame 52B. Specifically, the first engagement portion 133B has a shape in which the first engagement portion 133B first extends rightwards from a front end of the extended portion 133A, is then bent obliquely forwards and upwards and is finally bent leftwards. In addition, the second engagement portion 133C is disposed in a position which is offset (is caused to deviate by a predetermined distance) to the rear relative to the first engagement portion 133C.

Accordingly, three rod-shaped portions constituting the first engagement portion 133B become parallel to three rod-shaped portions constituting the second engagement portion 133C, respectively, and are disposed in positions which are spaced from each other by the same distance. The engagement portion 133 includes a pair of rod-shaped portions 133F, 133G which are provided parallel to each other. The rod-shaped portions 133F, 133G define bottom portions of the U-shaped first engagement portion 133B and the U-shaped second engagement portion 133C, respectively. The rod-shaped portions 133F, 133G constitute the wire side main body connecting portion 136 which is brought into contact with and electrically connected to a pin-shaped main body electrode (whose illustration is omitted) provided on the body housing 10.

The connecting portion 133D is formed so as to link an end portion of the first engagement portion 133B with an end portion of the second engagement portion 133C. In addition, a U-shaped portion which is formed by the connecting portion 133D, a part of the first engagement portion 133B adjacent to the connecting portion 133D and a part of the second engagement portion 133C adjacent to the connecting portion 133D is engaged with the engagement rib 216 on the drum upper frame 52B so as to surround the engagement rib 216.

The third engagement portion 133E is bent obliquely rearwards and downwards from the other end portion of the second engagement portion 133C. In addition, as shown in FIG. 7A, the third engagement portion 133E is engaged with an engagement piece 217 which is formed on the drum upper frame 52B from the front. Accordingly, the pin-shaped main body electrode (not shown) enters the pair of rod-shaped portions 133F, 133G and forces them to open wider, whereupon the movement of the third engagement portion 133E is regulated by the engagement piece 217, whereby the U-shaped first engagement portion 133B and the U-shaped second engagement portion 133C are deflected about the third engagement portion 133E and the connecting portion 133D. Then, the main body electrode is held between the pair of rod-shaped portions 133F, 133G in an ensured fashion by virtue of the deflected deformation of the first engagement portion 133B and the second engagement portion 133C.

The wire electrode 130 further includes a straight portion 137 formed between the coil portion 132 and the second spring leg portion 135 so as to be engaged with the holding hole 214. As shown in FIG. 7A, when the coil portion 132 is fitted in the holding hole 214, the straight portion 137 is engaged with the holding hole 124, which fixes the orientation of the coil portion 132. Accordingly, the engagement portion 133 is disposed spaced by a predetermined distance apart relative to the electrode attaching portion 213 at all times (see FIG. 9B). That is, when the straight portion 137 is not provided, the cylindrical coil portion 132 is allowed to rotate within the rectangular bottomed holding hole 214, and the engagement portion 133 is spaced apart too far relative to the electrode attaching portion 23. Therefore, the subsequent assemblage may become difficulty. However, by providing the straight portion 137 in the way described above, the problem described above can be solved.

Next, a method will be described for attaching the charging wire 110 on the drum upper frame 52B.

Figure 9A:
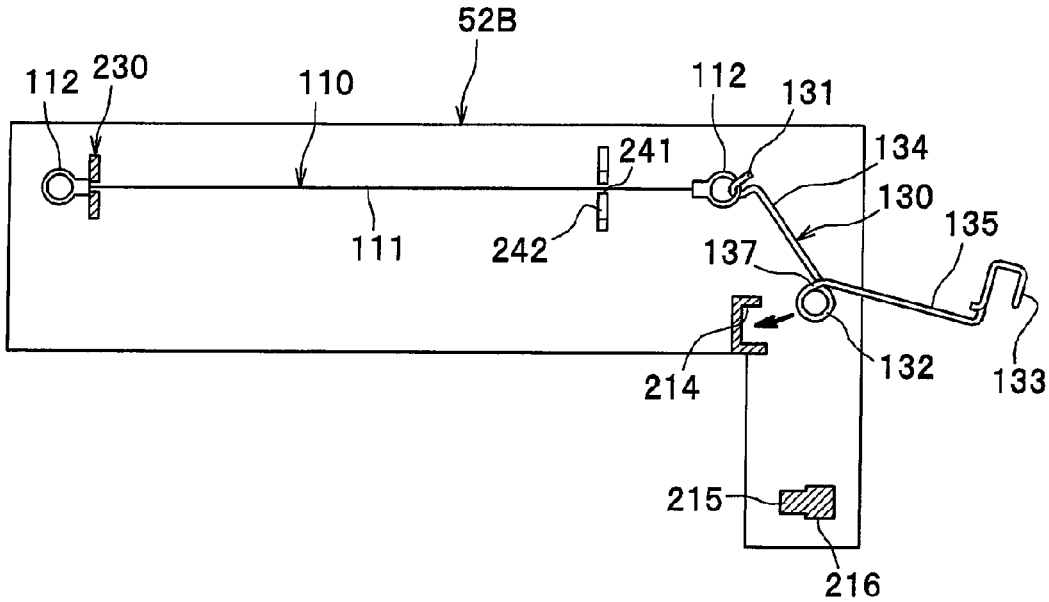
FIG. 9A is a schematic view showing a first step of a charging wire attaching method.
Figure 9B:
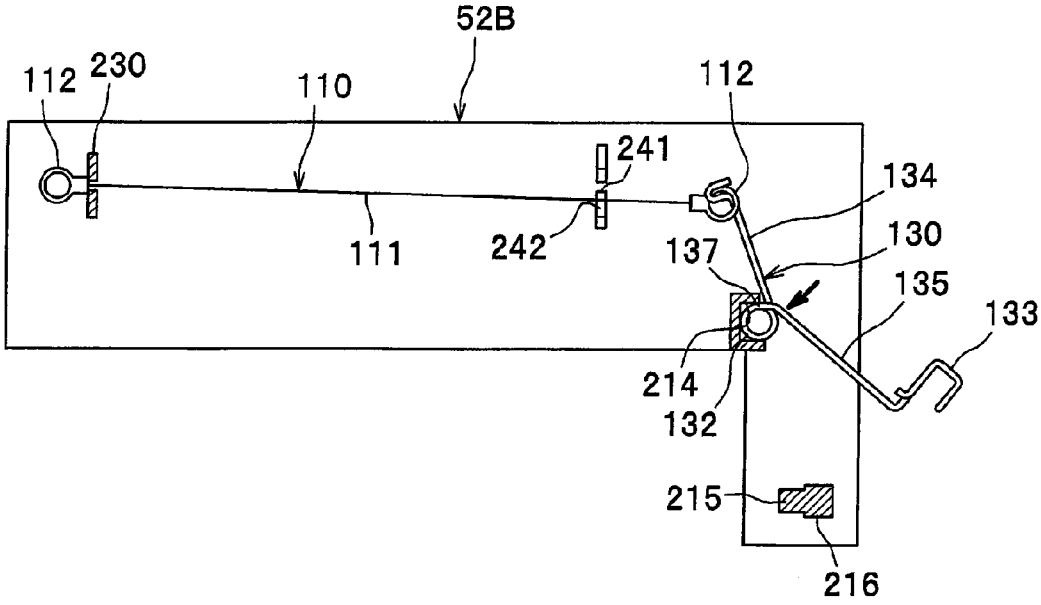
FIG. 9B is a schematic view showing a second step.

As shown in FIG. 9A, firstly, the left ring hook portion 112 of the charging wire 110 is locked to the wire locking portion 230 on the drum upper frame 52B, and the wire connecting portion 131 of the wire electrode 130 is engaged with the right ring hook portion 112 of the charging wire 110 (a first step). Thereafter, as is shown in FIG. 9B, the coil portion 132 of the wire electrode 130 is pushed into the holding hole 214 in the drum upper frame 52B so as to be fastened therein temporarily while maintaining a state in which a tension equal to or larger than a set value is not applied to the charging wire 110 (a second step). As this occurs, by the coil portion 132 being fitted in the holding hole 214 so as to be supported therein, the charging wire 110 is maintained in a state in which a tension larger than zero but smaller than the set value is applied to the charging wire 110 between the wire electrode 130 and the wire locking portion 230, whereby the charging wire 110 and the wire electrode 130 are put in a state (a temporarily fastened state) in which the charging wire 110 and the wire electrode 130 are kept almost stationary relative to the drum upper frame 52B (a temporarily fastened state).

Figure 10A:
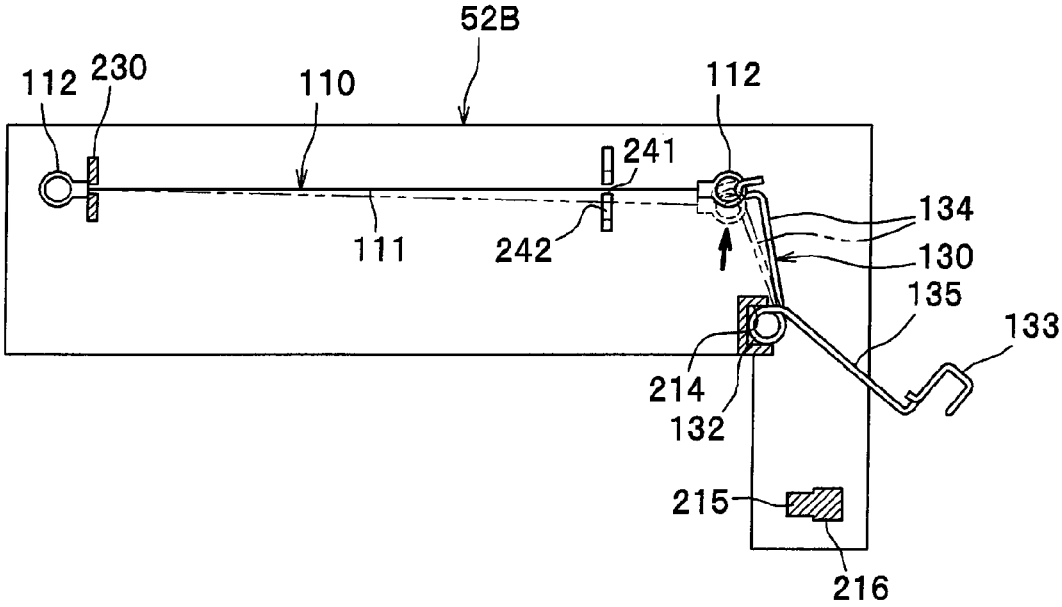
FIG. 10A is a schematic view showing a step in which a charging wire which is inclined obliquely is restored to its normal posture.

When the right portion of the charging wire 110 is pulled towards the coil portion 132 side by the wire electrode 130 when the coil portion 132 is pushed into the holding hole 214, there may occur a situation in which the wire portion 111 is inclined further obliquely than the normal posture (a posture shown in FIG. 10B) thereof. Even though such a case occurs, as shown in FIG. 10A, since the wire portion 111 faces the gentle inclined surface 242, the wire portion 111 is caused to move along the gentle inclined surface 242, and the wire portion 111 can be positioned within the wire insertion groove 241.

Figure 10B:
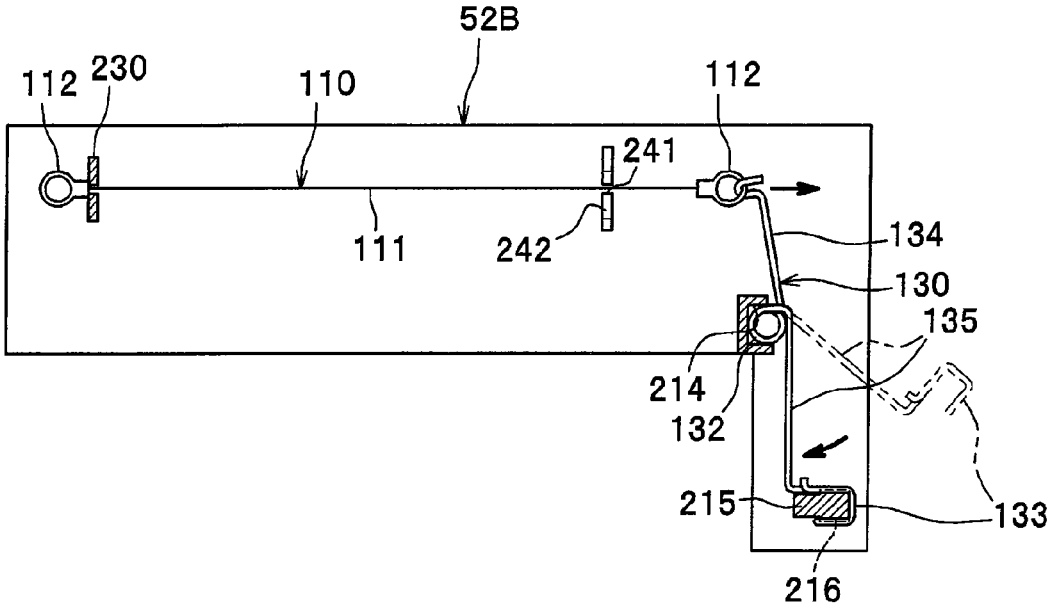
FIG. 10B is a schematic view showing a third step.

After the second step, as shown in FIG. 10B, the second spring leg portion 135 of the wire electrode 130 is caused to move in a direction (also referred to as a first direction in the embodiment) in which the deformation amount of the wire electrode 130 is increased (a direction in which the charging wire 110 is pulled), and the engagement portion 133 is caused to be fitted to the electrode support portion 215 on the drum upper frame 52B so as to be fixed thereto without causing the second spring leg portion 135 to return in the reverse direction (a third step). In other words, the second spring leg portion 135 is caused to move in the first direction until a fixing position at which the engagement portion 133 is fitted to the electrode support portion 215, without exceeding the fixed position in the first direction. The tension applied to the charging wire 110 is proportional to the deformation amount of the wire electrode 130 in a state in which the coil portion 132 is attached to the holding hole 214. When the engagement portion 133 is fitted to the electrode support portion 215, the tension equal to the setting value is applied to the charging wire 110. Consequently, although the tension applied to the charging wire 110 is gradually or progressively increased in association with the movement of the second spring leg portion 135, since the engagement portion 133 of the second spring leg portion 135 does not pass by the electrode support portion 215 but stays fitted thereon, the application of a tension which is larger than required to the charging wire 110 is suppressed.

After the charging wire 110 has been attached to the drum upper frame 52B (or before the charging wire 110 is attached to the drum upper frame 52B), other components (which include the grid 120 and the like) are assembled to the drum upper frame 52B. Accordingly, the drum upper frame 52B is manufactured. In addition, by assembling the drum lower frame 52A and the developing unit 61 to the drum upper frame 52B, the process cartridge 50 is manufactured.

The following advantages can be obtained in this embodiment.

The second spring leg portion 135 is made to continuously moved in the one direction without being caused to return in the reverse direction so as to be fitted to the electrode support portion 215 after the coil portion 132 of the wire electrode 130 has temporarily be fastened. In other words, the second spring leg portion 135 is caused to move in the first direction until a fixing position at which the engagement portion 133 is fitted to the electrode support portion 215, without exceeding the fixed position in the first direction. Accordingly, the application of the tension which is equal to or larger than the set value to the charging wire 110 can be suppressed.

By fitting the coil portion 132 in the holding hole 214 with the given fitting force and the charging wire 110 being stretched with the given tension, the charging wire 110 and the wire electrode 130 can temporarily be fastened to the drum upper frame 52B a state in which they are kept almost stationary. Consequently, even though the operator inclines or shakes slightly the drum upper frame 52B, the temporarily fastened state can be maintained, which facilitates the manufacturing of the process cartridge.

The introduction angle $\alpha$ of inclined surface 242 of the coil portion 132 side which is formed at the open end of the wire insertion groove 241 is made larger than the introduction angle $\beta$ of the opposite inclined surface 243. Therefore, even though the charging wire 110 is inclined more obliquely towards the holding hole 214 than its normal posture, the wire portion 111 can satisfactorily be guided into the wire insertion groove 241 along the wider inclined surface 242. Note that since the inclination of the charging wire 110 towards the holding hole 214 tends to occur easily when the method of the embodiment is adopted, by adopting the configuration in which the inclined surface 242 of the coil portion 132 side is made wider, the method of the embodiment can be improved further.

Since the regulating walls 232 of the wire locking portion 230 extend to face the portion of the ring link portion 112 which is positioned on the left side than the center thereof so as to support the half or more portion of the ring hook portion 112, the disjoining of the left ring hook portion 112 of the charging wire 110 from the regulating walls 232 of the wire locking portion 230 can be suppressed. Incidentally, in the method adopted in the related art in which the spring-shaped wire electrode is fixed in advance and the hook portion at the one end of the charging wire is pulled once to pass over the regulating wall so as to be thereafter locked on the abutment walls, the height of the regulating wall cannot be increased so that the tension equal to or larger than the set value and applied to the charging wire when it passes over the regulating wall does not become too large. In contrast to this, by adopting the attaching method of the embodiment, the half or more portion of the ring hook portion 112 can be supported while increasing the height of the regulating walls 232.

Since the engagement rib 216, which is disposed inside the connecting portion 133D, a part of the first engagement portion 133B and a part of the second engagement portion 133C of the wire electrode 130, is formed on the front surface of the electrode support portion 215, the disjoining of the wire electrode 130 from the electrode support portion 215 can be suppressed by the engagement rib 216 being brought into engagement with the connecting portion 133D and the like.

Since the front wall 222 of the electrode cover 220 is made to cover the engagement rib 216 and the connecting portion 133D and the like of the wire electrode 130, the disjoining of the wire electrode 130 from the electrode support portion 215 can be suppressed.

The invention is not limited to the above-described embodiment but can be made use of in various forms, some of which will be described below as examples.

In the above-described embodiment, the rectangular bottomed holding hole 214 is adopted as the coil support portion, but the invention is not limited thereto. For example, a circular cylindrical projection which is engaged with the inside of the ring hook portion may be adopted as a wire locking portion.

In the above-described embodiment, the pocket-like wire locking portion 230 including the abutment walls 231 and the regulating walls 232 is adopted, but the invention is not limited thereto. For example, a circular cylindrical projection which is adapted to be brought into engagement with the inside of the ring hook portion may be adopted.

In the above-described embodiment, the projection-shaped electrode support portion 215 is adopted, but the invention is not limited thereto. For example, a recessed electrode support portion may be adopted.

In the above-described embodiment, the ring-shaped ring hook portion 112 is adopted as the hook portion, but the invention is not limited thereto. For example, a hook-shaped hook portion may be adopted.

The above-described embodiment is applied to the color printer 1, but the invention is not limited thereto, and may be applied to other image forming apparatus, for example, a copying machine, a multi-function device and the like.

In the above-described embodiment, the process cartridge which can be divided into the two components such as the drum unit 51 and the developing unit 61 is adopted as a process cartridge, but the invention is not limited thereto. For example, a process cartridge in which a drum unit and a developing unit are formed integrally as a single unit or a process cartridge which can be divided into three components such as a drum unit, a developing unit and a toner cartridge may be adopted.

According to the embodiment of the invention, there is provided a method for attaching a charging wire, comprising: a first step of locking a first end of a charging wire to a wire locking portion formed on a process frame, and engaging a first spring leg portion of a torsion spring shaped wire electrode with a second end of the charging wire; a second step, after the first step, of attaching a coil portion of the wire electrode to a coil support portion formed on the process frame in a state in which a tension equal to or larger than a set value is not applied to the charging wire; and a third step, after the second step, of moving a second spring leg portion of the wire electrode in a first direction in which a deformation amount of the wire electrode increases, and fixing the second spring leg portion to an electrode support portion formed on the process frame by positioning the second spring leg portion at a fixing position, such that the second spring leg portion is moved without exceeding the fixed position in the first direction.

As used herein, the term "set value" means a tension applied to the charging wire at the time of final positioning (when the charging wire is attached to the process frame).

According to this method, in the second step, by attaching the coil portion to the coil support portion in a state in which a tension equal to or larger than the set value is not applied to the charging wire, the charging wire and the wire electrode are temporarily assembled to an approximate position relative to the process frame without the tension equal to or larger than the set value being applied to the charging wire. Thereafter, in the third step, when the second spring leg portion of the wire electrode is caused to move continuously, the tension applied to the charging wire is gradually increased. Then, by fixing the second spring leg portion to the electrode support portion without exceeding the fixed position in the first direction (in other words, without the second spring leg portion being caused to return in a second direction opposite to the first direction), the charging wire and the wire electrode are attached to the process frame when the tension applied to the charging wire has reached the set value.

According to the embodiment of the invention, there is also provided a process cartridge comprising: a charging wire comprising a wire portion and first and second hook portions which are provided at both ends of the wire portion, respectively; a torsion spring shaped wire electrode comprising a coil portion and first and second spring leg portions which are formed at both ends of the coil portion, respectively; and a process frame on which the charging wire and the wire electrode are attached, wherein the process frame comprises: a wire locking portion configured to lock the first hook portion of the charging wire; a coil support portion to which the coil portion of the wire electrode is fitted in a state in which the second hook portion of the wire electrode is engaged with a first spring leg portion; and an electrode support portion to which the second spring leg portion of the wire electrode is fixed, and wherein the coil portion and the coil support portion are configured such that a tension larger than zero but smaller than a set value is applied to the charging wire when the coil portion is fitted to the coil support portion in a state in which the first and second hook portions of the charging wire are respectively engaged with the wire locking portion and the first spring leg portion and in which the second spring leg portion of the wire electrode is disjoined from the electrode support portion.

According to this process cartridge, since the attaching method can be realized satisfactorily, the application of the tension equal to or larger than the set value to the charging wire can be suppressed. In addition, in this configuration, since the charging wire is pulled with the given or predetermined tension (which is larger than zero but smaller than the set value) between the wire locking portion and the wire electrode that is supported at the coil support portion after the second step (temporary assemblage) in the attaching method, a state (a temporary fastening state) is produced in which the charging wire and the wire electrode are fastened temporarily to the process frame so as to remain almost stationary thereon. Consequently, even when the operator inclines or slightly shakes the process frame after the second step, the temporarily fastened state can be maintained, whereby the manufacture can be facilitated.

According to the embodiment of the invention, since the second spring leg portion of the wire electrode is fixed to the electrode support portion without exceeding the fixed position in the first direction (without returning in the second direction), it is possible to suppress the application of the tension equal to or larger than the set value to the charging wire before the charging wire is finally attached to the process frame.

What is claimed is:

1. A method for attaching a charging wire, comprising:

locking a first end of a charging wire to a wire locking portion formed on a process frame, and engaging a first spring leg portion of a torsion spring shaped wire electrode with a second end of the charging wire;

attaching, after said locking the first end and said engaging the first spring leg portion, a coil portion of the wire electrode to a coil support portion formed on the process frame in a state in which a tension equal to or larger than a set value is not applied to the charging wire; and moving, after said attaching the coil portion, a second spring leg portion of the wire electrode in a first direction in which a deformation amount of the wire electrode increases, and fixing the second spring leg portion to an electrode support portion formed on the process frame by positioning the second spring leg portion at a fixing position, such that the second spring leg portion is moved to the fixing position without moving the second spring leg portion in a direction opposite to the first direction.

2. The method according to claim 1, wherein attaching the coil portion includes applying a tension larger than zero but smaller than the set value to the charging wire when the coil portion is attached to the coil support portion.

3. The method according to claim 1, wherein a tension equal to the set value is applied to the charging wire when the second spring leg portion is fixed to the electrode support portion.

4. The method according to claim 1, wherein the tension applied to the charging wire is proportional to the deformation amount of the wire electrode in a state in which the coil portion is attached to the coil support portion.

5. A method for manufacturing a process cartridge, comprising:

locking a first end of a charging wire to a wire locking portion formed on a process frame, and engaging a first spring leg portion of a torsion spring shaped wire electrode with a second end of the charging wire;

attaching, after said locking the first end and said engaging the first spring leg portion, a coil portion of the wire electrode to a coil support portion formed on the process frame so as not to apply a tension equal to or larger than a set value to the charging wire; and moving, after said attaching the coil portion, a second spring leg portion of the wire electrode in a first direction in which a deformation amount of the wire electrode increases, and fixing the second spring leg portion to an electrode support portion formed on the process frame by positioning the second spring leg portion at a fixing portion, such that the second spring leg portion is moved to the fixing position without moving the second spring leg portion in a direction opposite to the first direction.

6. The method according to claim 5, wherein attaching the coil portion includes applying a tension larger than zero but smaller than the set value to the charging wire when the coil portion is attached to the coil support portion.

7. The method according to claim 5, wherein a tension equal to the set value is applied to the charging wire when the second spring leg portion is fixed to the electrode support portion.

8. The method according to claim 5, wherein the tension applied to the charging wire is proportional to the deformation amount of the wire electrode in a state in which the coil portion is attached to the coil support portion.

9. A process cartridge comprising:

a charging wire comprising a wire portion and first and second hook portions which are provided at both ends of the wire portion, respectively;

a torsion spring shaped wire electrode comprising a coil portion and first and second spring leg portions which are formed at both ends of the coil portion, respectively; and a process frame on which the charging wire and the wire electrode are attached, wherein the process frame comprises:

a wire locking portion configured to lock the first hook portion of the charging wire;

a coil support portion to which the coil portion of the wire electrode is fitted in a state in which the second hook portion of the wire electrode is engaged with a first spring leg portion; and an electrode support portion to which the second spring leg portion of the wire electrode is fixed, and wherein the coil portion and the coil support portion are configured such that a tension larger than zero but smaller than a set value is applied to the charging wire when the coil portion is fitted to the coil support portion in a state in which the first and second hook portions of the charging wire are respectively engaged with the wire locking portion and the first spring leg portion and in which the second spring leg portion of the wire electrode is disjoined from the electrode support portion.

10. The process cartridge according to claim 9, wherein the first hook portion has a ring shape, wherein the wire locking portion comprises:

a pair of abutment walls which are provided to hold the wire portion therebetween so as to lock the first hook portion; and a regulating wall that faces the hook portion, and wherein the regulating wall extends further outwards than a center of the first hook portion in a direction in which the charging wire is stretched.

11. The process cartridge according to claim 9, wherein the second spring leg portion of the wire electrode comprises:

a first engagement portion that is bent into a U shape;

a second engagement portion that is bent into a U shape and is disposed parallel to the first engagement portion; and a connecting portion that connects an end portion of the first engagement portion with an end portion of the second engagement portion, and wherein the electrode support portion is shaped into a projection to which the first engagement portion and the second engagement portion are fitted, the projection having a facing surface that faces the connecting portion, the electrode support portion comprising an engagement rib formed in the facing surface so as to be disposed inside the connecting portion, the first engagement portion and the second engagement portion.

12. The process cartridge according to claim 11, further comprising an electrode cover detachably attached to the process frame so as to cover the wire electrode, wherein a part of the electrode cover covers the connecting portion and the engagement rib so as to suppress a disengagement of the connecting portion from the engagement rib.

13. The process cartridge according to claim 9, wherein a tension equal to the set value is applied to the charging wire when the second spring leg portion is fixed to the electrode support portion.

* * * * *